US007762854B1

(12) United States Patent
Peng

(10) Patent No.: US 7,762,854 B1
(45) Date of Patent: Jul. 27, 2010

(54) RF CONNECTOR ASSEMBLY

(75) Inventor: Chang Lin Peng, Jhonghe (TW)

(73) Assignee: F Time Technology Industrial Co., Ltd., Taipei County (TW)

( * ) Notice: Subject to any disclaimer, the term of this patent is extended or adjusted under 35 U.S.C. 154(b) by 0 days.

(21) Appl. No.: 12/468,107

(22) Filed: May 19, 2009

(51) Int. Cl.
*H01R 13/514* (2006.01)

(52) U.S. Cl. ..... 439/752; 439/578

(58) Field of Classification Search ..... 439/578, 439/752

See application file for complete search history.

(56) References Cited

U.S. PATENT DOCUMENTS 7,048,581 B1 * 5/2006 Wong ..... 439/595
7,544,081 B2 * 6/2009 Lim ..... 439/352

FOREIGN PATENT DOCUMENTS

CN I239699 9/2005
CN M315419 7/2007

* cited by examiner

*Primary Examiner*—Truc T Nguyen
(74) *Attorney, Agent, or Firm*—Guice Patents PLLC

(57) ABSTRACT

A RF connector assembly includes a male connector, and a female connector connected to the male connector for signal transmission. The female connector and male connector each have a U-shaped locating groove upwardly extending around the periphery of the electrically insulative housing thereof, a connector terminal device inserted into the electrically insulative housing, and a U-clamp mounted in the U-shaped locating groove and partially extended to the inside of the electrically insulative housing to secure the connector terminal device firmly in position.

12 Claims, 8 Drawing Sheets

RF CONNECTOR ASSEMBLY

BACKGROUND OF THE INVENTION

1. Field of the Invention

The present invention relates to an innovative design of RF connector assembly and more specifically, to the design of a U-shaped locating groove on the electrically insulative female connector housing or male connector housing and installation of a U-clamp in the U-shaped locating groove to secure the female connector terminal device or male connector terminal device inside the housing.

2. Description of the Related Art

A RF connector is adapted to connect two coaxial cables or one coaxial cable and one circuit board together for signal transmission.

Basically, A RF connector is comprised of a female connector and a male connector. By means of forcing a hook hole at a locating plate of the female connector into engagement with a hook at the male connector, the male connector and the female connector are fastened together.

Conventionally, the female connector and male connector each have an electrically insulative housing and a terminal device mounted inside the electrically insulative housing. When inserting the male connector into the female connector, the probe pin of the terminal device of the male connector is engaged into the receiving portion of the terminal device of the female connector, achieving electric conduction. Because the housing and the terminal device are made of different materials, connection between the housing and the terminal device can be done in many different ways.

Taiwan Patent Number I239699, entitled "connector structure II", discloses a structure of connector, which comprises a housing having a terminal chamber for accommodating a terminal device, a springy retaining bar formed integral with the housing in the terminal chamber and having a locating groove for the mounting of a clamp, a terminal device having annular grooves of different diameters arranged around the periphery for the engagement of the springy retaining bar temporarily, a clamp mounted in the locating groove of the springy retaining bar to provide a two-step clamping function. After connection of the first clamping structure of the clamp to the housing, the terminal device is fastened to the housing and the, the second clamping structure of the clamp is fastened to the housing. Of course, the clamp can be completely joined to the housing after connection of the terminal device to the housing, holding down the terminal device in place.

According to the aforesaid prior art design, the clamp must be inserted into the inside of the housing and fastened to the locating groove. However, because the locating groove is disposed inside the housing, it is difficult to set the clamp into position. According to this design, the clamp has a U-shaped configuration. Fastening the two arms of the U-shaped clamp to the two sides of the locating groove is not easy. More particularly, the small size of the housing makes the installation of the clamp more difficult. Further, because the housing and the clamp are respectively made of an electrically insulative material, for example, injection-molded from plastics, the clamp will be elastically deformed during its installation, complicating the installation. An improvement in this regard is necessary.

Further, Taiwan Patent Number M315419, entitled "Terminal mounting structure", discloses a terminal mounting structure, which comprises a housing that has an accommodation chamber axially extending through front and rear sides thereof, an inside annular flange extending around the inside wall thereof within the accommodation chamber, a pair of radial insertion slots disposed behind the inside annular flange in interference with the accommodation chamber, and a rear retaining wall at an opposite side relative to the radial insertion slots; a terminal device that has a front annular flange extending around the periphery near the front side, a rear annular flange extending around the periphery near the rear side and stopped against the rear retaining wall, and a middle annular groove extending around the periphery and spaced between the front annular flange and the rear annular flange; and a clamp that has a pair of clamping arms inserted into the accommodation chamber of the housing and clamped on the middle annular groove of the terminal device, and a hooked portion respectively located on the distal ends of the clamping arms and respectively hooked on the end edge of each of the radial insertion slots after insertion of the clamping arms through the radial insertion slots. By means of the clamp, the terminal device is rapidly installed in the housing and firmly secured in place. The housing and the clamp of this design of connector have a simple structure so that the molding and material costs can be greatly reduced.

Similar to Taiwan Patent Number I239699, Taiwan Patent Number M315419 needs to insert the clamp into the inside of the housing to hold the terminal device firmly in place. Same problems of installation difficulty and deformation of the clamp during installation will be encountered during installation of the connector.

Therefore, it is desirable to provide a RF connector assembly that eliminates the aforesaid problems.

SUMMARY OF THE INVENTION

The present invention has been accomplished under the circumstances in view. It is one object of the present invention to provide a RF connector assembly, which facilitates installation.

To achieve this and other objects of the present invention, a RF connector assembly comprises a male connector, and a female connector connected to the male connector for signal transmission. The female connector comprises an electrically insulative housing having a U-shaped locating groove upwardly extending around the periphery, a female connector terminal device inserted into the electrically insulative housing, and a U-clamp mounted in the U-shaped locating groove and partially extended to the inside of the electrically insulative housing to secure the female connector terminal device firmly in position.

To achieve this and other objects of the present invention, a RF connector assembly comprises a male connector, and a female connector connected to the male connector for signal transmission. The \male connector comprises an electrically insulative housing having a U-shaped locating groove upwardly extending around the periphery, a male connector terminal device inserted into the electrically insulative housing, and a U-clamp mounted in the U-shaped locating groove and partially extended to the inside of the electrically insulative housing to secure the male connector terminal device firmly in position.

To achieve this and other objects of the present invention, a RF connector assembly comprises a male connector, and a female connector connected to the male connector for signal transmission. The female connector and the female connector each comprise an electrically insulative housing having a U-shaped locating groove upwardly extending around the periphery, a connector terminal device inserted into the electrically insulative housing, and a U-clamp mounted in the U-shaped locating groove and partially extended to the inside of the electrically insulative housing to secure the connector terminal device firmly in position.

DETAILED DESCRIPTION OF THE PREFERRED EMBODIMENT

Figure 1:
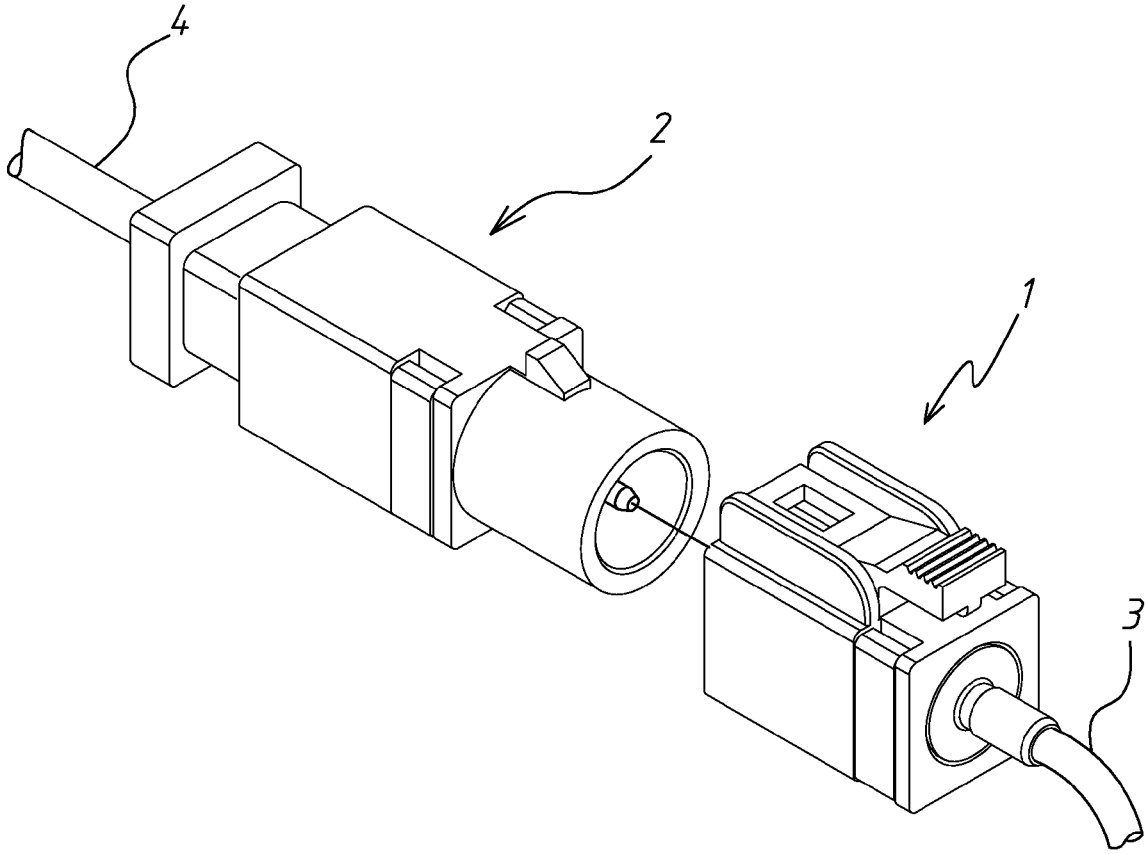
FIG. 1 is an exploded view of a RF connector assembly in accordance with the present invention.
Figure 2:
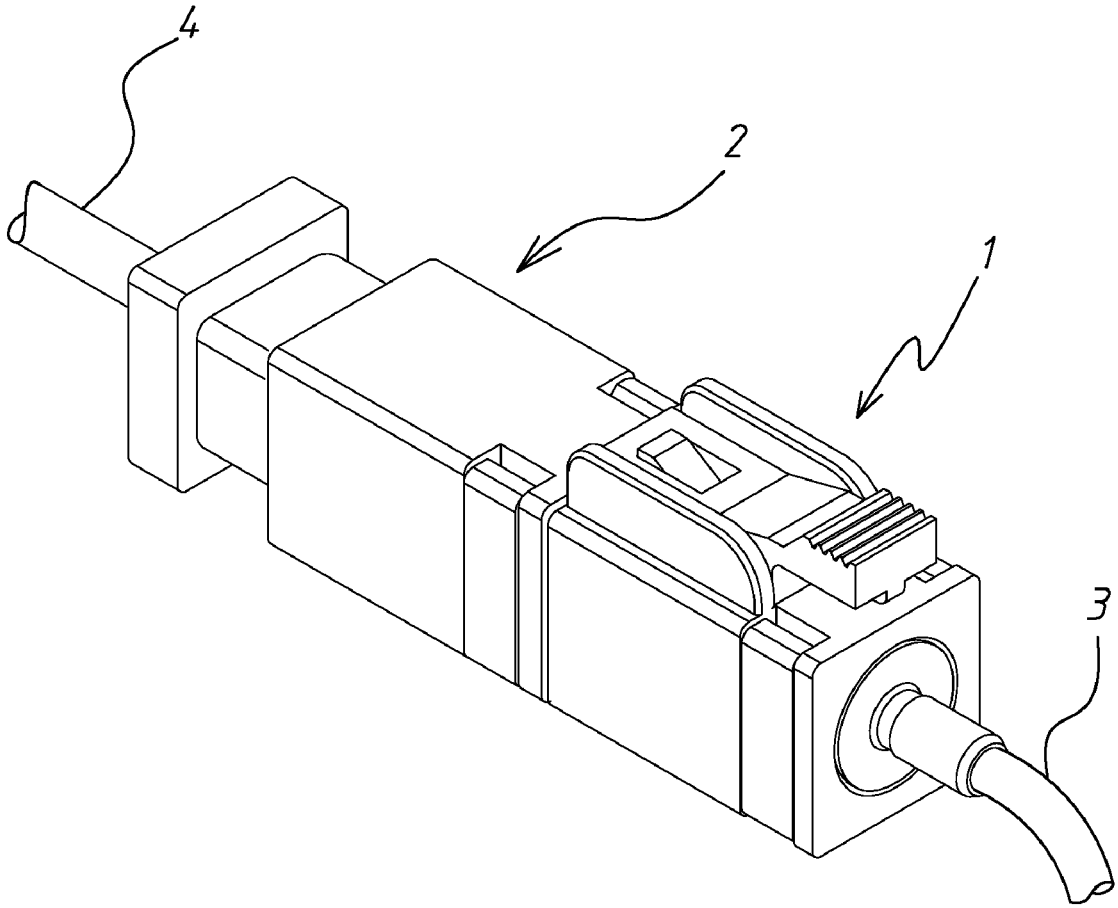
FIG. 2 is an elevational view of the present invention, showing the male connector and the female connector connected together.
Figure 3:
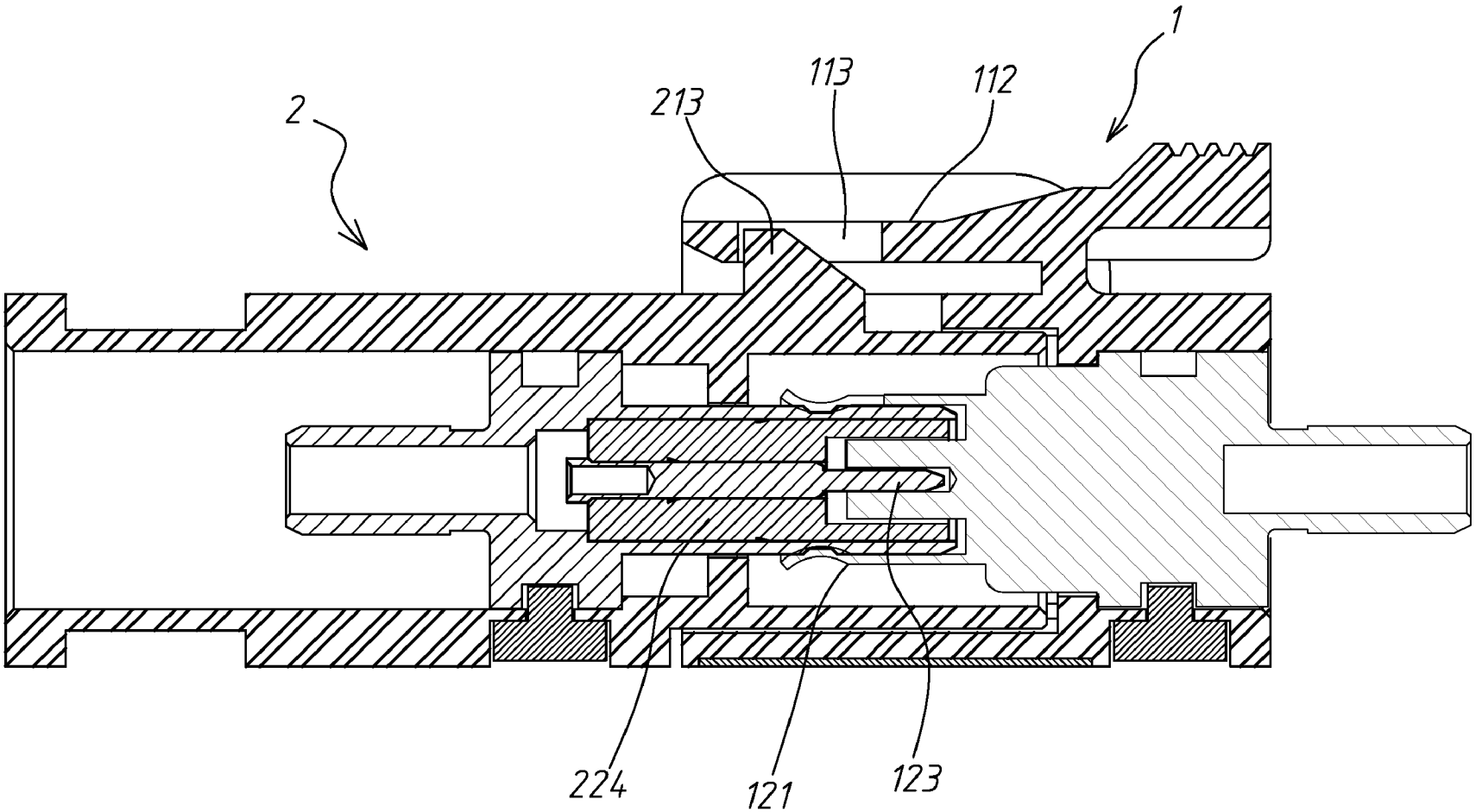
FIG. 3 is a sectional assembly view of the RF connector assembly in accordance with the present invention/

Referring to FIGS. 1~3, a RF connector assembly in accordance with the present invention is shown comprising a female connector 1 and a male connector 2. When the female connector 1 and the male connector 2 are connected together, cable 3 and cable 4 (or a circuit board and a cable) are electrically connected for signal transmission.

Figure 4:
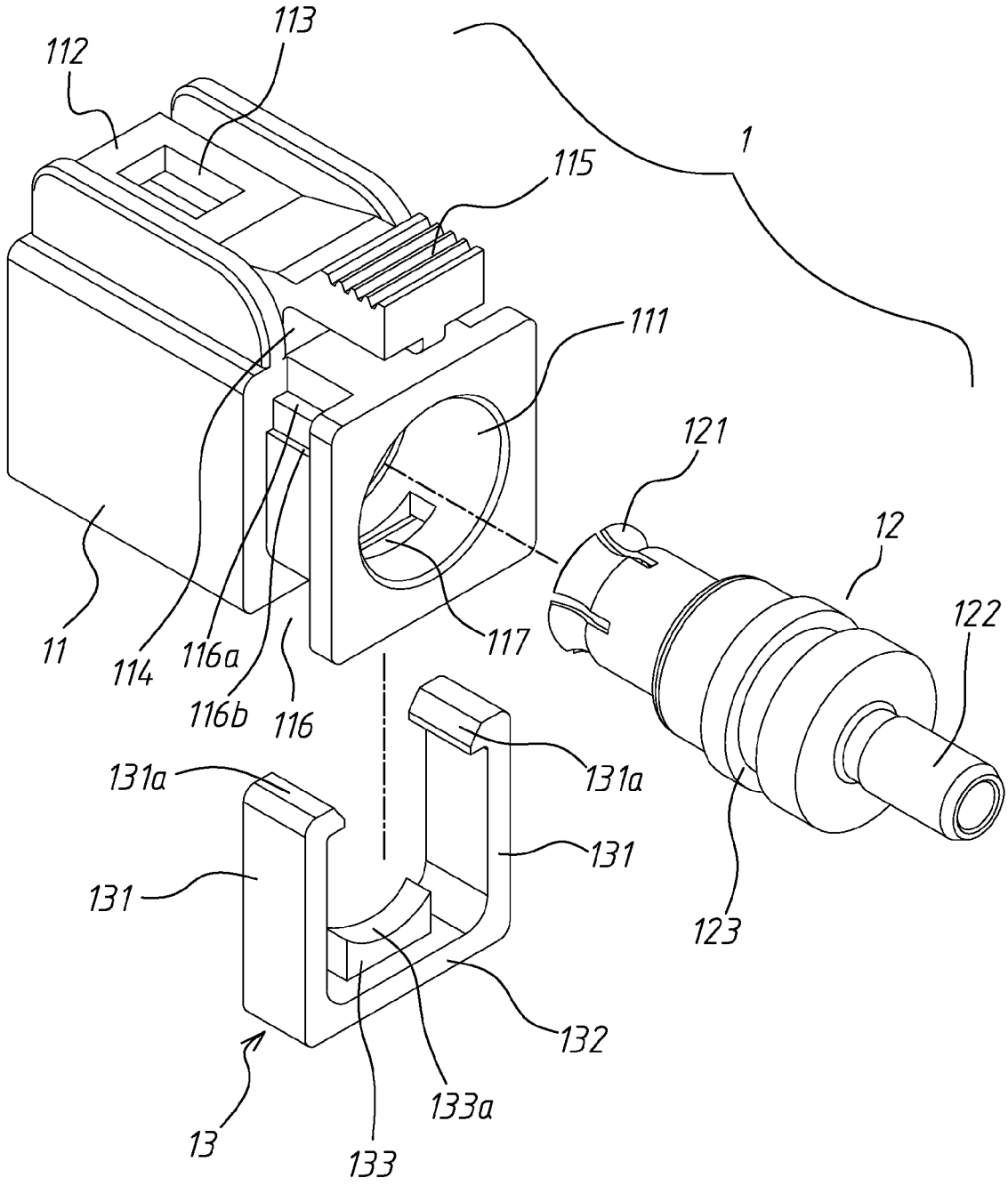
FIG. 4 is an exploded view of the female connector of the RF connector assembly in accordance with the present invention.
Figure 5:
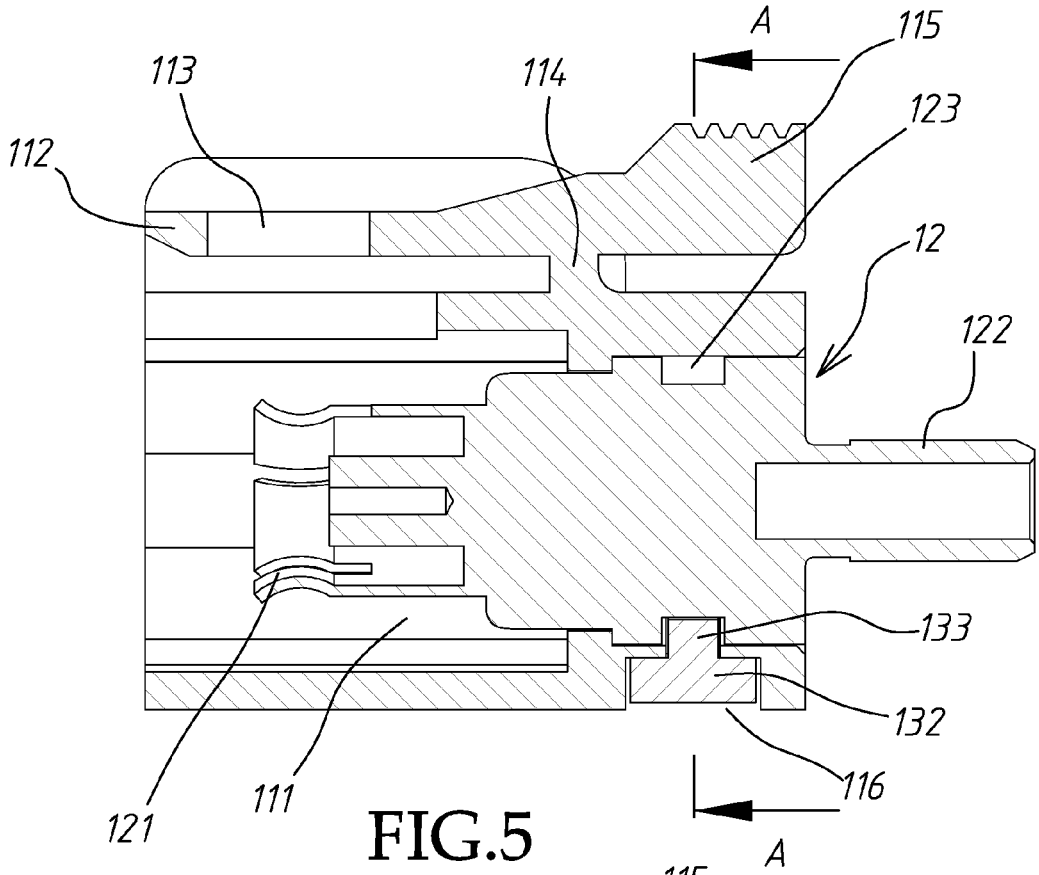
FIG. 5 is a sectional assembly view of the female connector of the RF connector assembly in accordance with the present invention.
Figure 6:
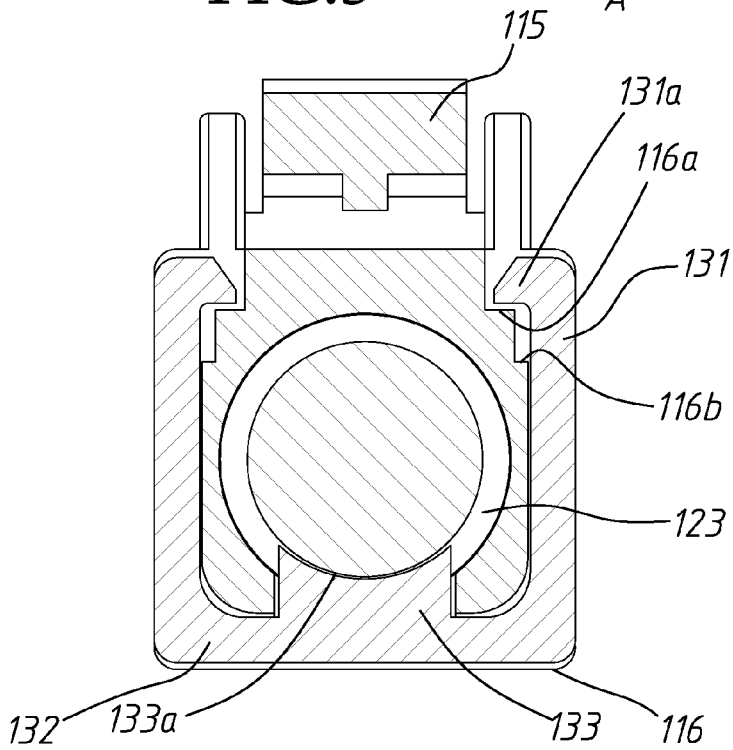
FIG. 6 is a sectional view taken along line A-A of FIG. 5.

Referring to FIGS. 4~6, the female connector 1 comprises an electrically insulative female connector housing 11, a female connector terminal device 12 and a U-clamp 13.

The electrically insulative female connector housing 11 is substantially a hollow rectangular shell having an insertion hole 111 extending through the front and rear sides thereof, a suspension frame strip 112 suspending at the top open side thereof and connected to the rear wall of the electrically insulative female connector housing 11 by a connection portion 114, a hook hole 113 defined in the frame strip 112, a handle 115 backwardly extended from the suspension frame strip 112 and the connection portion 114 and pressable to displace the hook hole 114, a U-shaped locating groove 116 extending upwardly around the periphery toward the top side and disposed near the rear side, a bottom through hole 117 cut through the U-shaped locating groove 166 in communication with the insertion hole 111, a first step 116*a* and a second step 116*b* located on each of the two ends of the U-shaped locating groove 166 at different elevations.

The female connector terminal device 12 can be made of an electrically conductive material. Further, the female connector terminal device 12 is mounted in the insertion hole 111 of the electrically insulative female connector housing 11, having a front receiving portion 121, a rear tubular end portion 122 for the connection of a cable 3 (see FIG. 1), and a locating groove 123 extending around the periphery and disposed at the top side of the bottom through hole 117 of the electrically insulative female connector housing 11.

The U-clamp 13 has two arms 131, a base portion 132 connected between one end of each of the two arms 131, a tooth block 133 protruded from the top side of the base portion 132, and a hooked portion 131*a* extended from the other end of each of the two arms 131. The tooth block 133 has a concave top wall 133*a*.

Referring to FIGS. 5 and 6 again, the U-clamp 13 is fastened to the U-shaped locating groove 166 of the electrically insulative female connector housing 11 to force the tooth block 133 through the bottom through hole 177 into engagement with the locating groove 123, thereby securing the female connector terminal device 12 to the electrically insulative female connector housing 11 (see FIG. 3 or 5).

Further, the first step 116*a* and the second step 116*b* that are located on each of the two ends of the U-shaped locating groove 166 are disposed at different elevations, constituting a stepped structure.

Figure 10:
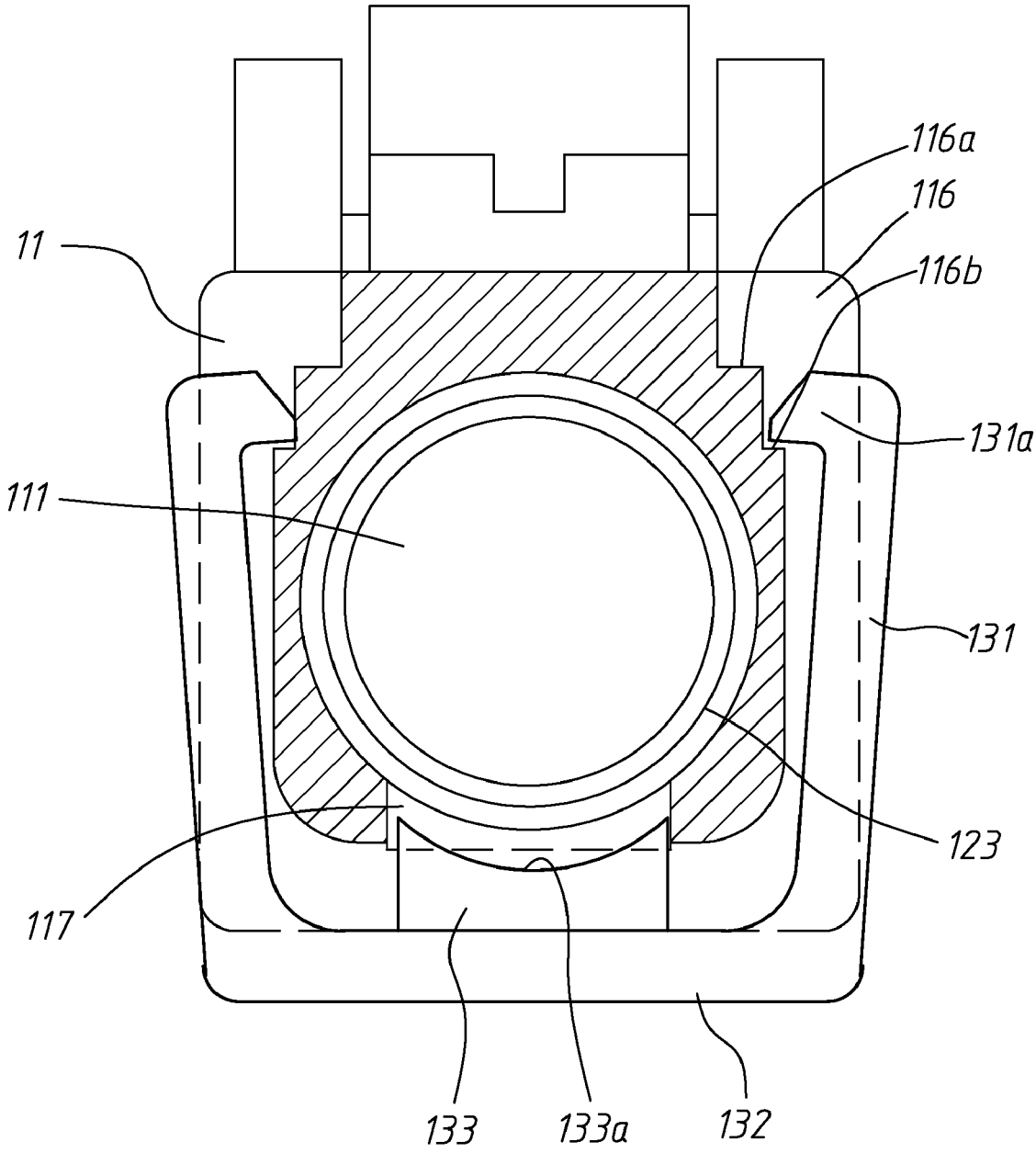
FIG. 10 is a schematic sectional view of the present invention, showing the U-clamp fastened to the electrically insulative female connector housing.

Referring to FIG. 10, when fastening the U-clamp 13 to the U-shaped locating groove 166 of the electrically insulative female connector housing 11, the two hooked portions 131*a* are moved along the U-shaped locating groove 166 to the lower steps, i.e., the second steps 116*b*, at this time, as illustrated, the tooth block 133 is forced into the bottom through hole 177 without projecting into the inside of the insertion hole 111, thereby achieving pre-assembly function. Thereafter, the female connector terminal device 12 is inserted into the insertion hole 111 of the electrically insulative female connector housing 11 to aim the locating groove 123 at the bottom through hole 177, and then the U-clamp 13 is pushed upwards to move the two hooked portions 131*a* away from the second steps 116*b* into engagement with the first steps 116*a* (see FIG. 6) and simultaneously to force the tooth block 133 into engagement with the locating groove 123, thereby finishing the assembly process of the female connector 1. This design facilitates the installation of RF connector assembly.

Figure 7:
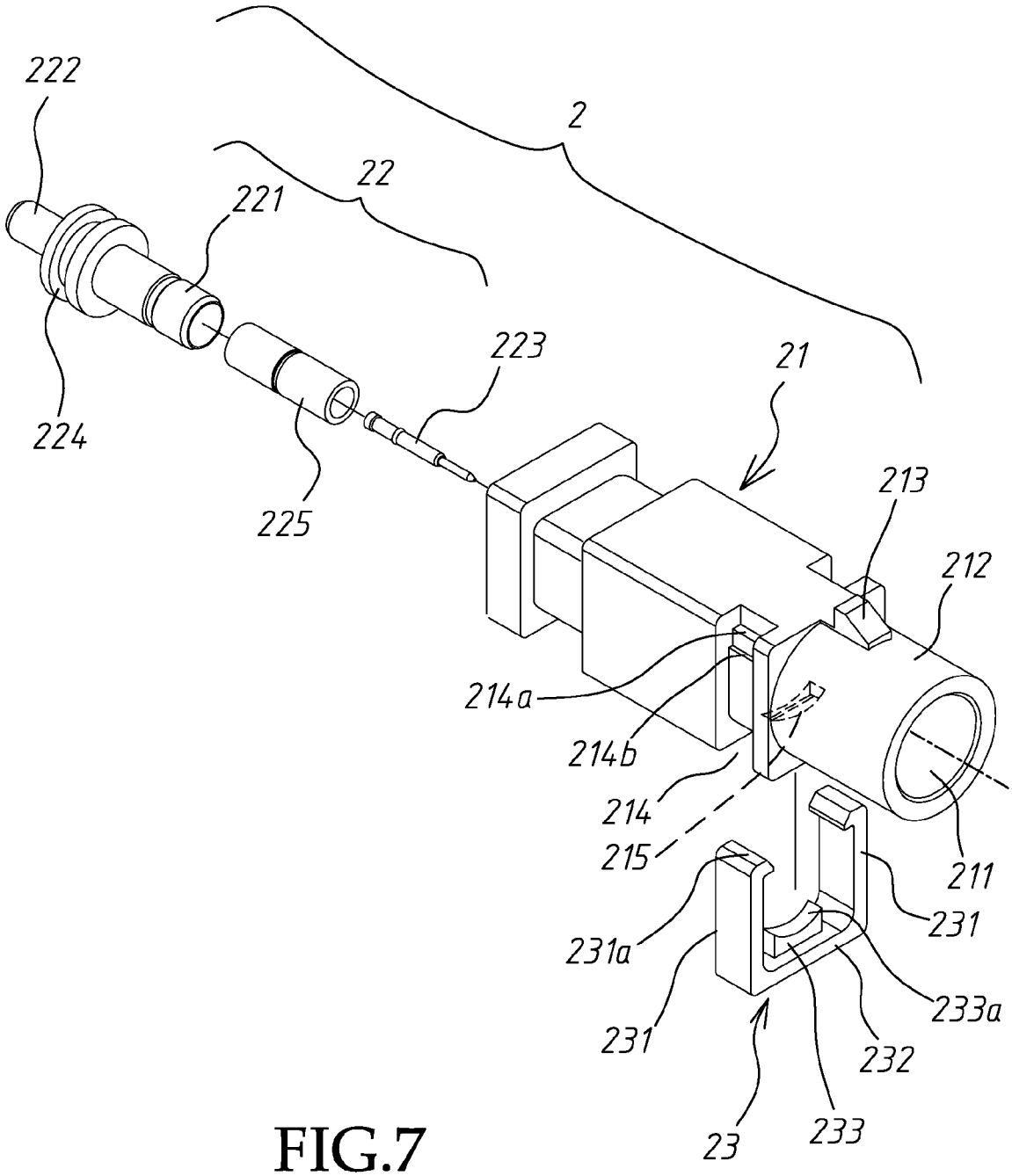
FIG. 7 is an exploded view of the male connector of the RF connector assembly in accordance with the present invention.
Figure 8:
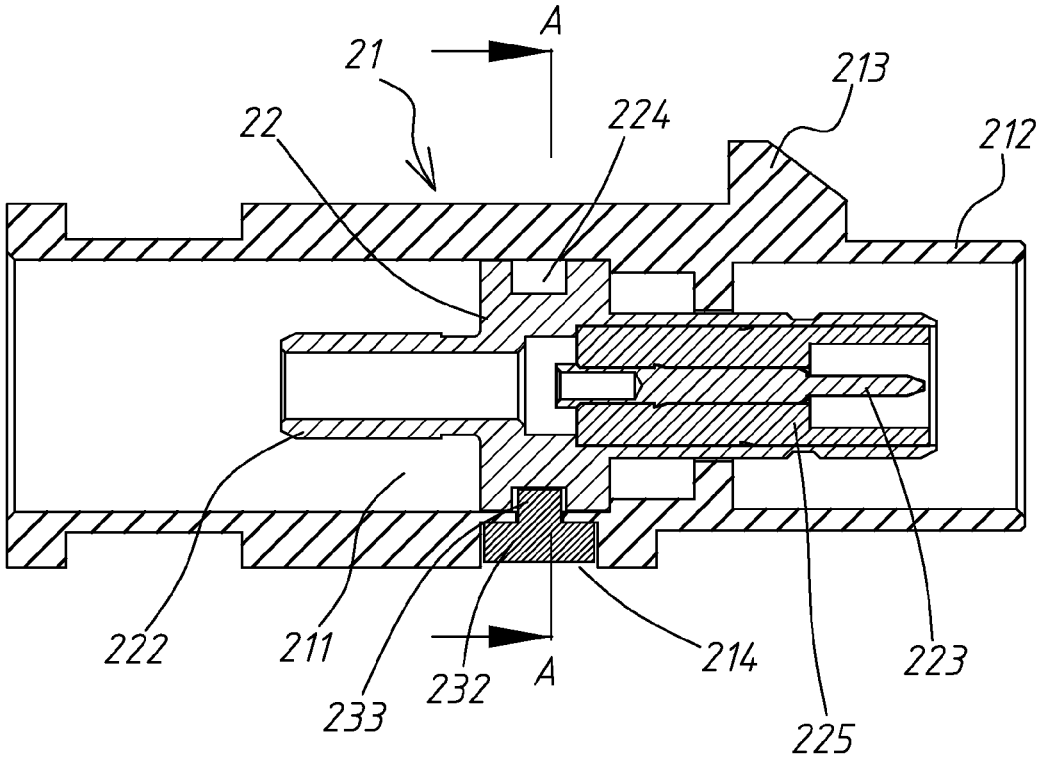
FIG. 8 is a sectional assembly view of the male connector of the RF connector assembly in accordance with the present invention.

Referring to FIGS. 7 and 8, the male connector 2 comprises an electrically insulative male connector housing 21, a male connector terminal device 22 and a U-clamp 23.

The electrically insulative male connector housing 21 has a circular axial hole 211 extending through the front and rear sides thereof, a tubular plug portion 212 disposed at the rear side around the circular axial hole 211 for insertion into the insertion hole 111 of the electrically insulative female connector housing 11, a hook 213 protruded from the periphery of the tubular plug portion 212 at the top side for hooking in the hook hole 113 after insertion of the tubular plug portion 212 into the insertion hole 111 (see FIG. 2 or 3), a U-shaped locating groove 214 extending upwardly around the periphery toward the top side and disposed near the tubular plug portion 212, a bottom through hole 215 cut through the U-shaped locating groove 214 in communication with the circular axial hole 211, a first step 214*a* and a second step 214*b* located on each of the two ends of the U-shaped locating groove 214 at different elevations.

The male connector terminal device 22 is made of an electrically conductive material and mounted in the circular axial hole 211 of the electrically insulative male connector housing 21, comprising a hollow base member 221, a probe pin 223 and a socket 225. The hollow base member 221 has a rear tubular end portion 222 for the connection of a cable 4 and a locating groove 224 extending around the periphery. The socket 225 is mounted in the hollow base member 221 to hold the probe pin 223 inside the hollow base member 221 in a concentric manner such that when the hollow base member 221 is inserted into the receiving portion 121 of the female connector terminal device 12, the female connector terminal device 12 and the male connector terminal device 22 are electrically connected.

Further, the U-clamp 23 is substantially similar to the U-clamp 13 of the female connector 1, having two arms 231, a base portion 232 connected between one end of each of the two arms 231, a tooth block 233 protruded from the top side of the base portion 232, and a hooked portion 231*a* extended from the other end of each of the two arms 231. The tooth block 233 has a concave top wall 233*a*.

Figure 9:
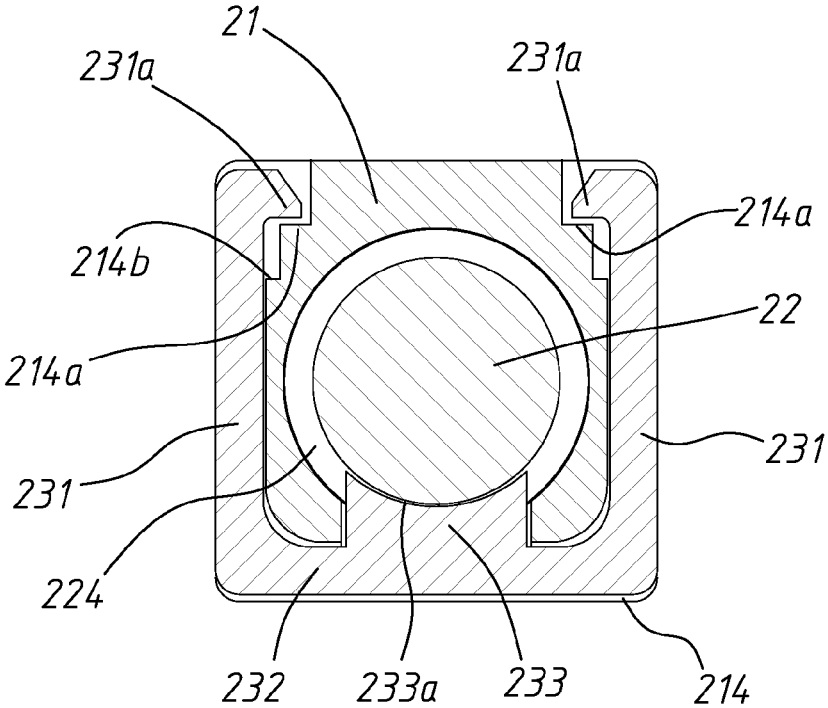
FIG. 9 is a sectional view taken along line A-A of FIG. 8.

Referring to FIGS. 8 and 9, the U-clamp 23 is fastened to the U-shaped locating groove 214 of the electrically insulative male connector housing 21 to force the tooth block 233 through the bottom through hole 215 into engagement with the locating groove 224, thereby securing the male connector terminal device 22 to the electrically insulative male connector housing 21 (see FIG. 7).

Further, the first step 214*a* and the second step 214*b* that are located on each of the two ends of the U-shaped locating groove 214 are disposed at different elevations, constituting a stepped structure. Similar to the female connector 1 (see FIG. 10), the U-clamp 23 can be clamped on the first steps 214*a* before installation of the male connector terminal device 22.

Obviously, the female connector 1 and male connector 2 of the RF connector assembly of the present invention use one respective U-clamp 13 or 23 to secure the respective female connector terminal device 12 or male connector terminal device 22 in position. The arrangement of the U-shaped locating groove 116 at the electrically insulative female connector housing 11 and the U-shaped locating groove 214 at the electrically insulative male connector housing 21 facilitates the installation of the respective U-clamps 13 and 23. Further, because the U-clamps 13 and 23 are made of a flexible insulative material, for example, plastics, the fabrication precision of the U-clamps 13 and 23 is less critical without affecting installation.

According to the above-described preferred embodiment of the present invention, U-shaped locating grooves 116 and 214 are respectively provided at the electrically insulative female connector housing 11 and electrically insulative male connector housing 21 of the female connector 1 and male connector 2 for the mounting of the respective U-clamps 13 and 23 to secure the female connector terminal device 12 and the male connector terminal device 22 respectively. In actual practice, only one of the female connector 1 and male connector 2 can be provided with a U-shaped locating groove for the mounting of one U-clamp.

A prototype of RF connector assembly has been constructed with the features of FIGS. 1~10. The RF connector assembly functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A RF connector assembly, comprising:

a female connector, said female connector comprising:

an electrically insulative female connector housing, said electrically insulative female connector housing having an insertion hole extending through front and rear sides thereof, a suspension frame strip suspending at a top open side thereof and connected to a rear wall of the electrically insulative female connector housing by a connection portion, and a hook hole defined in said frame strip, a handle backwardly extended from said suspension frame strip and said connection portion and pressable to displace said hook hole; and a female connector terminal device made of an electrically conductive material and mounted in said insertion hole of said electrically insulative female connector housing, said female connector terminal device having a front receiving portion, a rear tubular end portion for the connection of a cable; and a male connector, said male connector comprising:

an electrically insulative male connector housing, said electrically insulative male connector housing having a circular axial hole extending through front and rear sides thereof, a tubular plug portion disposed at the rear side around said circular axial hole for insertion into the insertion hole of said electrically insulative female connector housing, a hook protruded from the periphery of said tubular plug portion at a top side for hooking in said hook hole after insertion of said tubular plug portion into said insertion hole; and a male connector terminal device made of an electrically conductive material and mounted in said circular axial hole of said electrically insulative male connector housing, said male connector terminal device comprising a hollow base member having a rear tubular end portion for the connection of a cable, a probe pin, and a socket mounted in said hollow base member to hold said probe pin inside said hollow base member;

wherein:

said electrically insulative female connector housing has a U-shaped locating groove upwardly extending around the periphery thereof and a bottom through hole upwardly cut through the U-shaped locating groove in communication with said insertion hole; said female connector terminal device has a locating groove extending around the periphery thereof and aimed at the bottom through hole of said electrically insulative female connector housing; said female connector further comprises a U-clamp mounted in the U-shaped groove of said electrically insulative female connector housing to secure said female connector terminal device in place, the U-clamp of said female connector having two arms respectively clamped on the U-shaped groove of said electrically insulative female connector housing, a base portion connected between one end of each of the two arms, and a tooth block protruded from the base portion and inserted through the bottom through hole said electrically insulative female connector housing into engagement with the locating groove of said female connector terminal device.

2. The RF connector assembly as claimed in claim 1, wherein the U-clamp of said female connector has a hooked portion extended from an opposite end of each of the two arms thereof; said electrically insulative female connector housing has a first step located on each of the two ends of the U-shaped locating groove thereof for the hooking of the hooked portions of the U-clamp of said female connector.

3. The RF connector assembly as claimed in claim 1, wherein said electrically insulative female connector housing has a second step located on each of the two ends of the U-shaped locating groove thereof at a bottom side of the associating first step to constitute a stepped structure for the hooking of the hooked portions of the U-clamp of said female connector.

4. The RF connector assembly as claimed in claim 1, wherein the tooth block of the U-clamp of said female connector has a concave top wall.

5. A RF connector assembly, comprising:

a female connector, said female connector comprising:

an electrically insulative female connector housing, said electrically insulative female connector housing having an insertion hole extending through front and rear sides thereof, a suspension frame strip suspending at a top open side thereof and connected to a rear wall of the electrically insulative female connector housing by a connection portion, and a hook hole defined in said frame strip, a handle backwardly extended from said suspension frame strip and said connection portion and pressable to displace said hook hole; and a female connector terminal device made of an electrically conductive material and mounted in said insertion hole of said electrically insulative female connector housing, said female connector terminal device having a front receiving portion, a rear tubular end portion for the connection of a cable; and a male connector, said male connector comprising:

an electrically insulative male connector housing, said electrically insulative male connector housing having a circular axial hole extending through front and rear sides thereof, a tubular plug portion disposed at the rear side around said circular axial hole for insertion into the insertion hole of said electrically insulative female connector housing, a hook protruded from the periphery of said tubular plug portion at a top side for hooking in said hook hole after insertion of said tubular plug portion into said insertion hole; and a male connector terminal device made of an electrically conductive material and mounted in said circular axial hole of said electrically insulative male connector housing, said male connector terminal device comprising a hollow base member having a rear tubular end portion for the connection of a cable, a probe pin, and a socket mounted in said hollow base member to hold said probe pin inside said hollow base member;

wherein:

said electrically insulative male connector housing has a U-shaped locating groove upwardly extending around the periphery thereof and a bottom through hole upwardly cut through the U-shaped locating groove in communication with said circular axial hole; said hollow base member of said male connector terminal device has a locating groove extending around the periphery thereof and aimed at the bottom through hole of said electrically insulative male connector housing; said male connector further comprises a U-clamp mounted in the U-shaped groove of said electrically insulative male connector housing to secure said male connector terminal device in place, the U-clamp of said male connector having two arms respectively clamped on the U-shaped groove of said electrically insulative male connector housing, a base portion connected between one end of each of the two arms, and a tooth block protruded from the base portion and inserted through the bottom through hole said electrically insulative male connector housing into engagement with the locating groove of said hollow base member of said female connector terminal device.

6. The RF connector assembly as claimed in claim 5, wherein the U-clamp of said male connector has a hooked portion extended from an opposite end of each of the two arms thereof; said electrically insulative male connector housing has a first step located on each of the two ends of the U-shaped locating groove thereof for the hooking of the hooked portions of the U-clamp of said male connector.

7. The RF connector assembly as claimed in claim 5, wherein said electrically insulative male connector housing has a second step located on each of the two ends of the U-shaped locating groove thereof at a bottom side of the associating first step to constitute a stepped structure for the hooking of the hooked portions of the U-clamp of said male connector.

8. The RF connector assembly as claimed in claim 5, wherein the tooth block of the U-clamp of said male connector has a concave top wall.

9. A RF connector assembly, comprising:

a female connector, said female connector comprising:

an electrically insulative female connector housing, said electrically insulative female connector housing having an insertion hole extending through front and rear sides thereof, a suspension frame strip suspending at a top open side thereof and connected to a rear wall of the electrically insulative female connector housing by a connection portion, and a hook hole defined in said frame strip, a handle backwardly extended from said suspension frame strip and said connection portion and pressable to displace said hook hole; and a female connector terminal device made of an electrically conductive material and mounted in said insertion hole of said electrically insulative female connector housing, said female connector terminal device having a front receiving portion, a rear tubular end portion for the connection of a cable; and a male connector, said male connector comprising:

an electrically insulative male connector housing, said electrically insulative male connector housing having a circular axial hole extending through front and rear sides thereof, a tubular plug portion disposed at the rear side around said circular axial hole for insertion into the insertion hole of said electrically insulative female connector housing, a hook protruded from the periphery of said tubular plug portion at a top side for hooking in said hook hole after insertion of said tubular plug portion into said insertion hole; and a male connector terminal device made of an electrically conductive material and mounted in said circular axial hole of said electrically insulative male connector housing, said male connector terminal device comprising a hollow base member having a rear tubular end portion for the connection of a cable, a probe pin, and a socket mounted in said hollow base member to hold said probe pin inside said hollow base member;

wherein:

said electrically insulative female connector housing has a U-shaped locating groove upwardly extending around the periphery thereof and a bottom through hole upwardly cut through the U-shaped locating groove in communication with said insertion hole; said female connector terminal device has a locating groove extending around the periphery thereof and aimed at the bottom through hole of said electrically insulative female connector housing; said female connector further comprises a U-clamp mounted in the U-shaped groove of said electrically insulative female connector housing to secure said female connector terminal device in place, the U-clamp of said female connector having two arms respectively clamped on the U-shaped groove of said electrically insulative female connector housing, a base portion connected between one end of each of the two arms, and a tooth block protruded from the base portion and inserted through the bottom through hole said electrically insulative female connector housing into engagement with the locating groove of said female connector terminal device;

said electrically insulative male connector housing has a U-shaped locating groove upwardly extending around the periphery thereof and a bottom through hole upwardly cut through the U-shaped locating groove in communication with said circular axial hole; said hollow base member of said male connector terminal device has a locating groove extending around the periphery thereof and aimed at the bottom through hole of said electrically insulative male connector housing; said male connector further comprises a U-clamp mounted in the U-shaped groove of said electrically insulative male connector housing to secure said male connector terminal device in place, the U-clamp of said male connector having two arms respectively clamped on the U-shaped groove of said electrically insulative male connector housing, a base portion connected between one end of each of the two arms, and a tooth block protruded from the base portion and inserted through the bottom through hole said electrically insulative male connector housing into engagement with the locating groove of said hollow base member of said female connector terminal device.

10. The RF connector assembly as claimed in claim 9, wherein the U-clamp of said female connector and the U-clamp of said male connector each have a hooked portion extended from an opposite end of each of the two arms thereof; said electrically insulative female connector housing and said electrically insulative male connector housing each have a first step located on each of the two ends of the U-shaped locating groove thereof for the hooking of the hooked portions of the associating U-clamp.

11. The RF connector assembly as claimed in claim 9, wherein said electrically insulative female connector housing and said electrically insulative male connector housing each have a second step located on each of the two ends of the respective U-shaped locating groove at a bottom side of the associating first step to constitute a stepped structure for the hooking of the hooked portions of the U-clamp of said male connector.

12. The RF connector assembly as claimed in claim 9, wherein each of the tooth blocks of the U-clamps of said male connector and said female connector has a concave top wall.

* * * * *